US006543054B2

(12) United States Patent
Gabriel

(10) Patent No.: US 6,543,054 B2
(45) Date of Patent: Apr. 8, 2003

(54) BODILY-INJURY PROTECTIVE CLOTHING AND ACCESSORIES FOR OUTDOORS AND IN A VEHICLE

(76) Inventor: Edwin Zenith Gabriel, 91 Mt. Tabor Way, Ocean Grove, NJ (US) 07756

( * ) Notice: Subject to any disclaimer, the term of this patent is extended or adjusted under 35 U.S.C. 154(b) by 0 days.

(21) Appl. No.: 09/752,928

(22) Filed: Jan. 2, 2001

(65) Prior Publication Data

US 2002/0083513 A1 Jul. 4, 2002

(51) Int. Cl.[7] ..... A41D 13/00
(52) U.S. Cl. ..... 2/1; 2/DIG. 3; 280/730.1
(58) Field of Search ..... 2/455, 463–467, 2/16, 24, 44, 62, 911, 468, 916, 69, DIG. 3; 280/728.1, 730.1, 730.2, 734; 441/92–93, 108

(56) References Cited

U.S. PATENT DOCUMENTS 3,921,222 A * 11/1975 Hollman ..... 2/463
4,370,754 A * 2/1983 Donzis ..... 2/16
D302,874 S * 8/1989 Bossart ..... D29/6
4,948,168 A * 8/1990 Adomeit et al. ..... 280/732
5,091,992 A * 3/1992 Pusic ..... 2/456
5,295,709 A * 3/1994 Bell ..... 180/274
5,362,098 A * 11/1994 Guill ..... 280/733
5,692,710 A * 12/1997 Gee ..... 244/118.5
6,151,714 A * 11/2000 Pratt ..... 2/24
6,336,653 B1 * 1/2002 Yaniv et al. ..... 280/730.1

* cited by examiner

*Primary Examiner*—John J. Calvert
*Assistant Examiner*—Tejash Patel

(57) ABSTRACT

Injury protective clothing for children and the elderly would help protect them from injury of the neck, breast area, upper and lower back, knees and ankles. The clothing consists of inflated and energy-absorption annular, moisture-proof, non-inflammable rip-resistant closures placed around injury-susceptible areas of the body. The protective clothing could be decorative with stars, stripes, flowers, birds, butterflies, animals, rings, diamond shapes, hearts and whatever else would be appealing to children and the elderly. Persons of all ages could wear the protective gear, but this application targets those most vulnerable to injury,—children because of their being so active, climbing trees, fences, ladders, and jumping off high places, and the elderly. Children take chances more than adults would. Some enclosures are 360° circular and others have elastic bands to allow the enclosure to stretch more easily to clothe oneself with the garment.

6 Claims, 9 Drawing Sheets

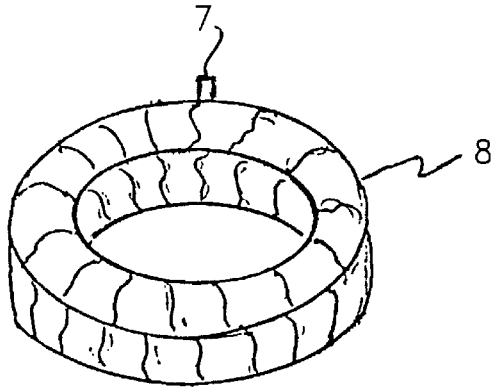
*FIG. 8*
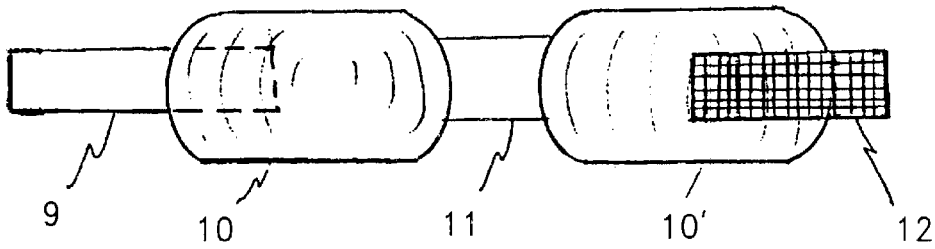
*FIG. 9*
*FIG. 9A*
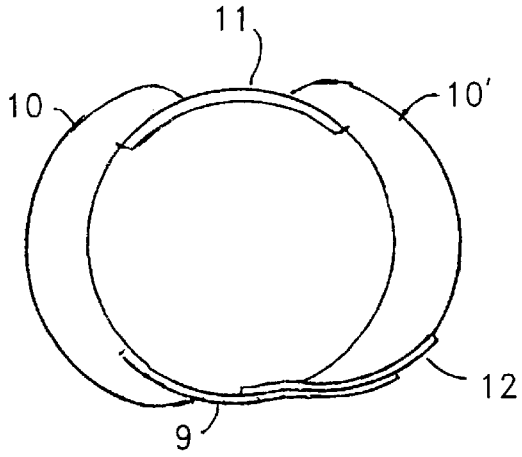

BUTTERFLIES

RASPBERRIES

HEARTS

YELLOW ROSES

RED ROSES

DAISIES

BRICK ROWS

CELESTIAL

GUNDY BERRIES

BIRDS

SUGGESTED DECORATIONS FOR PROTECTIVE CLOTHING

BODILY-INJURY PROTECTIVE CLOTHING AND ACCESSORIES FOR OUTDOORS AND IN A VEHICLE

CROSS-REFERENCES TO RELATED APPLICATIONS

This is not a continuation-in-part of a previous application, and not one that is co-pending

RIGHTS TO INVENTIONS MADE UNDER FEDERALLY-SPONSORED RESEARCH AND DEVELOPMENT

None of the work on this invention was performed under any Federally-sponsored or State-sponsored research and development. Gabriel used his own resources on every phase of this project.

BACKGROUND OF THE INVENTION

1. Field of the Invention

This invention is in the field of the avoidance of bodily injury for youngsters and the elderly. Now, children wear baggy clothing, rainware, coats with insulation, but not protection from injury. The elderly, also wear rainware and coats with insulated lining in winter. These garments do not protect a person from bodily injury. Children wear helmets, sometimes goggles, when riding a small bicycle, in case of a fall. The same is true when children ride in a vehicle; their bodies are not protected from injury when an auto collision occurs. Children are not wearing padding around their knees, their breast, and neck areas are not protected from injury. Even wearing a buckled safety belt will not protect an adult from having a breast-bone injury fracture, when the vehicle stops suddenly, and the adult is a passenger, sitting next to the driver, needs protection too. Thus, to avoid injury, whether walking, running or riding in a vehicle, one should wear injury protective gear, such as inflatable annular enclosures where injury to one's body is most likely to occur. Children and elderly persons are the ones most likely to incur bodily injury. That is why this invention is focused on the very young and the very old, to assist in their avoidance of injury. The padding could be sponge rubber, enclosed in a fabric container, or it could be an air-inflated, air-tight enclosure. If the protection is made part of the garment, then air-inflated padding would be preferred, instead of sponge rubber filler material. Sponge-rubber filled enclosure is just a suggestion. Any non-hazardous, energy-absorbing substance could be substituted for the sponger-rubber filler.

2. Description of Prior Art

The inventor is only aware of patents applied for under his name that relate to the present invention. U.S. patent application, Ser. No. 09/722 236, filed 11/27/00, "Collision Protection System for Cars", includes knee protection for the driver and his front seat passenger, and body protection apparel for the passenger. Then, there are fabric knee supports for those with worn or bruised knee joints, but these supports are not injury protective. Then, there are cervical collars for those who have sustained neck injuries; however, these collars are worn only after a person has experienced a neck injury. They are not decorative and are very noticeable for being worn because of an injury. Injured persons wear elastic Ace bandage wrapped around sprained ankles and wrists, but an Ace bandage does not protect one against an injury; there is no energy-absorption material included in the material. Finally, head helmets protect the head only. Head injuries are not addressed in this invention, because helmets already exist and are very available.

SUMMARY OF THE INVENTION

With today's high incidence of bodily injuries, such as knees, back, ankles and neck, attention needs to be given to injury-protection wearing apparel, which would not necessarily increase the weight of clothing. Young children and the elderly are most likely to suffer injury and the ones who need the protective devices more than others. Consequently, cervical, decorated collars are suggested for the neck; annular donut-shaped inflated enclosures are suggested for the chest and back areas; padded or inflated donut-shaped enclosures are suggested for one's knees, and cushioned spats are suggested for one's ankles, especially ankles of the wobbly elderly. All exposed, injury-protected gear could be suitably decorated to beautify their appearance. Women, in particular, like to wear decorative, colorful clothing.

BRIEF DESCRIPTION OF DRAWINGS

For the purpose of illustrating the bodily protective gear for children and the elderly described, the following drawings show forms which are presently preferred. It is to be understood that this invention is not necessarily limited to the precise arrangement, instrumentalities and field of utility as therein demonstrated. The file of this patent contains at least one drawing executed in color. Copies of this patent with color drawing(s) will be provided by the Patent and Trademark Office upon request and payment of the necessary fee.

FIG. 8 shows a perspective view of a cervical collar with its energy absorbing material surrounded by elastic, moisture resistant fabric.

FIG. 9 shows protection gear for protecting body portions with hook and loop-fastener and body strips at its ends for strapping said gear around one's body.

FIG. 9A shows the injury protective gear of FIG. 9 enclosed circularly to show how it would look strapped to a person with Velcro attached to clinging pile.

DESCRIPTION OF A PREFERRED EMBODIMENT

Figure 3:
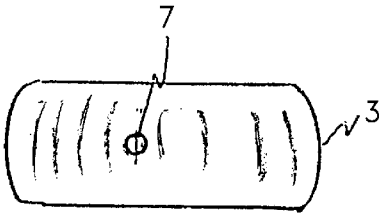
FIG. 3 is a side view.
Figure 2:
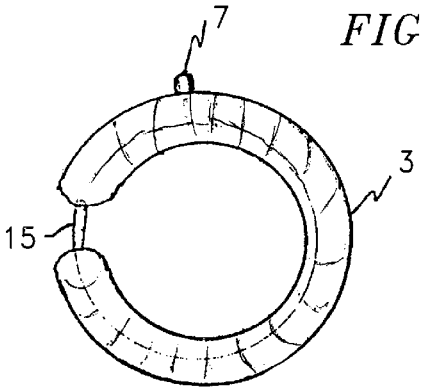
FIG. 2 shows an inflated donut-shaped body protection enclosure for a child's body or knees with elastic bands tying the two ends for positioning the protective gear on the desired portion of the body.
Figure 4:
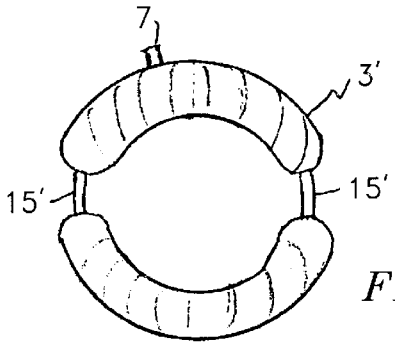
FIG. 4 shows an inflated donut-shaped protection with the protection enclosures divided into two portions and the portions held together with rubber bands, so a circular loop protection is provided.
Figure 5:
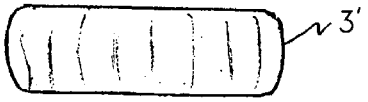
FIG. 5 is a side view thereof.
Figure 1:
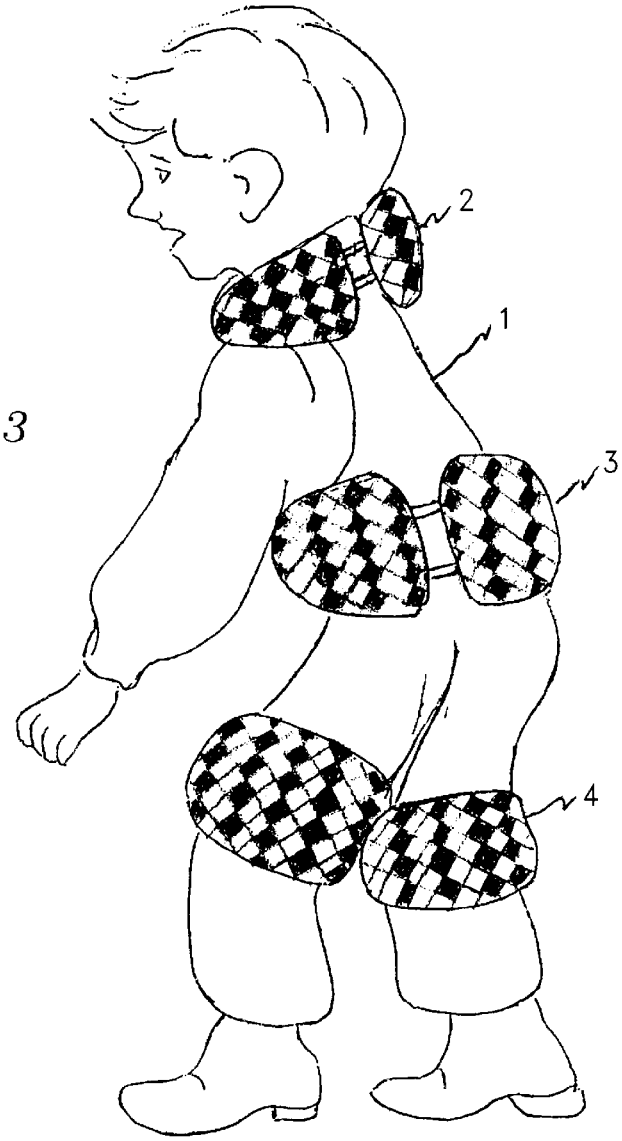
FIG. 1 shows a picture of a boy in the process of being active.

In the embodiments illustrated in FIGS. 1 to 9A emphasize the bodily protection of children from injury, as a result of falling, being hit by an object or by other sources. Helmets and goggles are not included in the protective gear, because these items have not been modified or improved upon. Just portions of the body below the head are addressed. In FIG. 1, in boy 1, his neck is protected by air-inflated collar 2; his body, underneath his arms, is protected by inflated enclosure 3; and his knees are protected by enclosures 8, FIG. 8, which have energy-absorbing material, such as sponge rubber. FIG. 3 shows a plan view of an inflated donut-shaped enclosure with rubber-banded material 15 holding the circular portion together, and enabling the enclosure to expand when placed in positioning it over the child's body. FIG. 4 shows a similar enclosure as FIG. 2 with two rubber-banded elastic materials 15' holding the circular portions together, allowing more expansion for the enclosure. FIGS. 3 and 5 show side views 3 and 3' of FIGS. 2 and 5, respectively. Numeral 7 points to an air valve.

Figure 6:
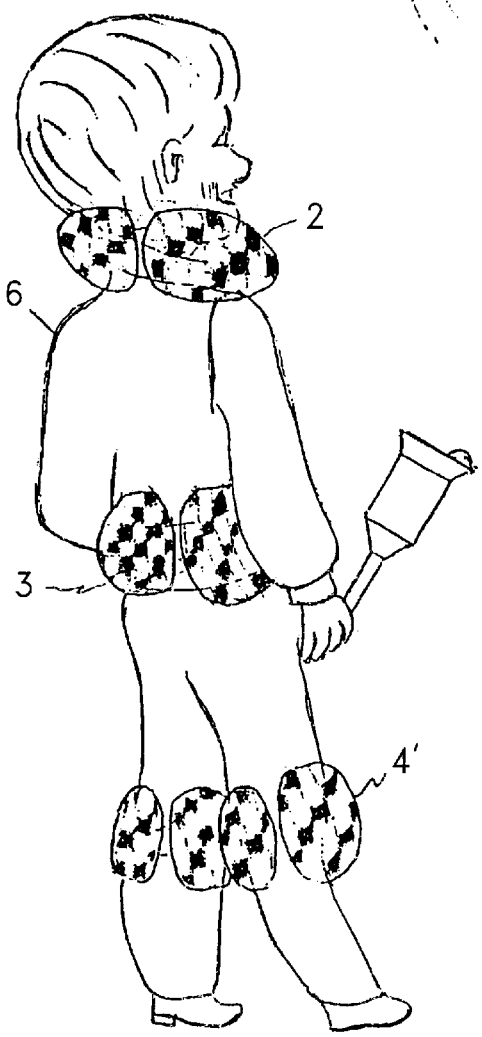
FIG. 6 shows the back view of a child.
Figure 7:
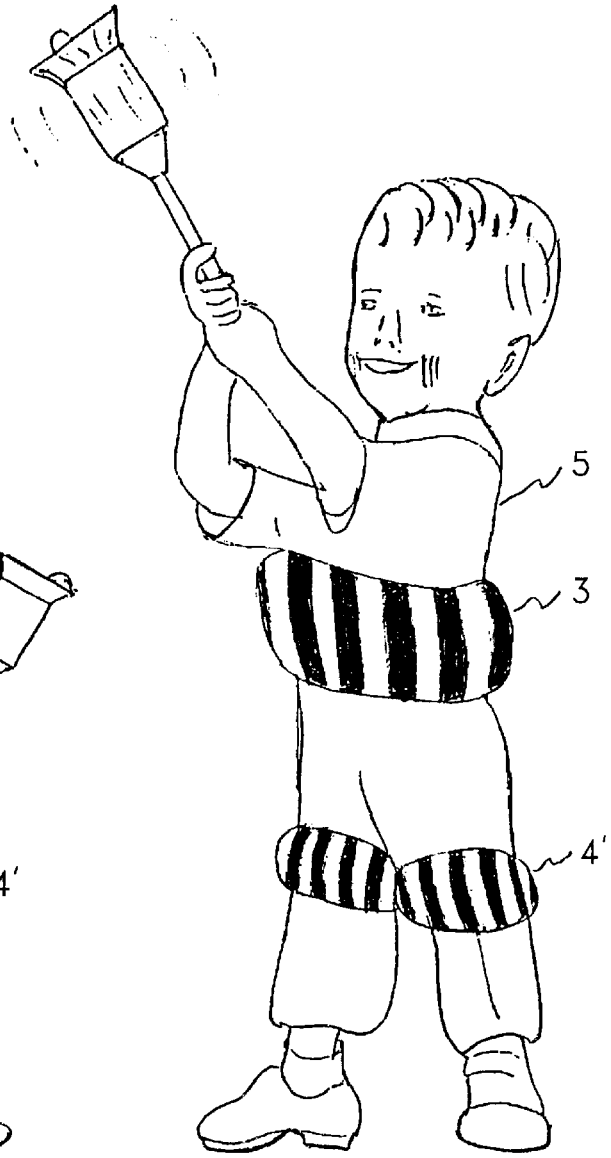
FIG. 7 shows a front view of another child, holding a bell and ringing the bell. Both boys are wearing injury-protective devices. Both children could be engaged in active sports and wearing protective gear.

FIGS. 6 and 7 show other children 5 and 6, in the act of playing, with similar protective gear for bodily safety from injury. The protective gear is decorated with either stripes or diamond shapes; however, flowers or pictures of birds and animals could have been the decorations. Boy 5, FIG. 7, is wearing striped protective gear 3 and 4', while boy 6, FIG. 6, is wearing other decorative, protective gear 2, 3 and 4', as shown.

FIG. 8 shows a perspective view of wrinkled, donut-shaped enclosure 7 for application to either a boy's knees or the upper part of his body. The outer cover of device 8 is made of elastic fabric, filled with, say, sponge rubber, energy-absorbing material. The wrinkled elastic fabric is water-resistant and enables its interior opening to stretch either to fit over his head and onto his body, or to fit onto his knee-portion. This donut-shaped enclosure would come into different sizes, being smaller for small parts of his body and larger for his larger parts. Also some people have large thighs, legs, and some have large necks. Just like hat sizes, protective gear 8 could come in different sizes for different-sized persons, young and older persons.

For the body 3, protective gear, FIG. 9, could be substituted. In this protective configuration, gear, FIG. 9, consists of Velcro 9, enclosure 10, with sponge rubber filling, elastic fabric or band 11, enclosure 10', with sponge rubber filling, and clinging pile, sewed onto the covering of enclosure 101. One would encircle one's body with this contraption and strap its ends together by placing Velcro 9 over clinging pile 12. Enclosures 10 and 10' would provide bodily protection, when positioned either around one's hips or around one's chest. FIG. 9A shows the injury protective gear of FIG. 9 circularly enclosed to show how it would look strapped to a person with Velcro 9 attached to clinging pile 12.

DESCRIPTION OF ANOTHER PREFERRED EMBODIMENT

Figure 10:
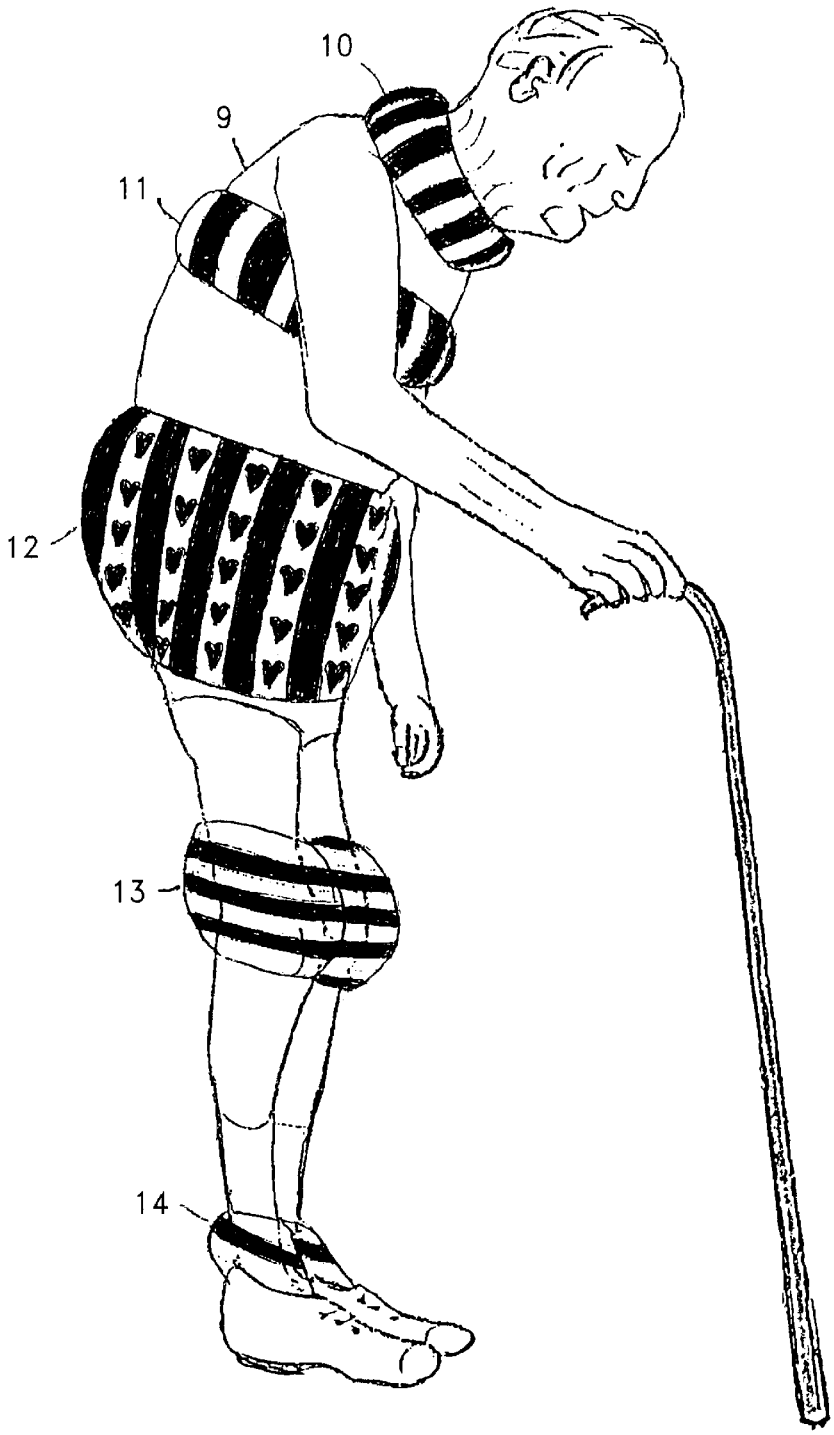
FIG. 10 shows an elderly man, somewhat unsteady on his feet, protected by a cervical collar, around his neck, protective gear with energy-absorbing material around his waste, elastic collars with energy-absorbing material around his knees, and spats with energy-absorbing material around his ankles. He is shown somewhat naked but he could be wearing clothing, and the physical protective gear could be surrounding his clothing at the appropriate places of his body.

Elderly persons, unsteady on their feet, are prone to fall and be injured. They also need bodily protection from injury in places where injury is more likely to occur, such as neck, ribs, a person's rear portion, knees and ankles. An annular enclosure, such as 8, FIG. 8, could be used for the neck and ribs portion. For the lower body portion, such as oneis hips, annular enclosure 3, FIGS. 2 and 3, could be used for protection, or the contraption shown in FIG. 9. For protection of one's knees, a smaller size annular enclosure 8, FIG. 8, could be applied. Then, for one's ankles, spats, as used in days gone by, could be applied, as shown. Some ice skaters use such ankle protective devices to avoid spraining their ankles, when falling. These protective gear for the body could be decorated with flowers, stripes, other shaped images to provide color and beauty to one's garments. The elderly man 9, FIG. 10, is wearing beach ware, summer season. The person illustrated could have been an elderly woman. Some of the same protective garments, such as neck collar 10, knee protectors 13 and annular enclosure 11, for breast and rib protection, could be used in a vehicle, for auto collision protection.

Today, people live longer, but at a more advanced age their knees and other body parts, such as ankles, could be more unsteady. Hence, elderly people tend to be more wobbly on their feet. Knee protection could make them less wobbly by strengthening their knee joints. Regarding a protector for such a person's knees, protective device, FIG. 9, with Velcro and clinging pile straps, the straps could be pulled tighter for a person wanting to change a ceiling light bulb, for example, thus enabling his or her knees to be less wobbly.

It should be added that a corset pulls a woman's stomach in but does not possess energy-absorption protection against a blow. A fabric with elastic web material for support of a person's sacrum and lower spine does not possess energy-absorption protection.

A person needs to be protected from injury while in a vehicle and he may not be wearing injury-protective garments, so the vehicle's interior surfaces need to have bodily injury-protection, particularly at one's lower body, where the vehicle's air bags provide no protection.

Figure 11:
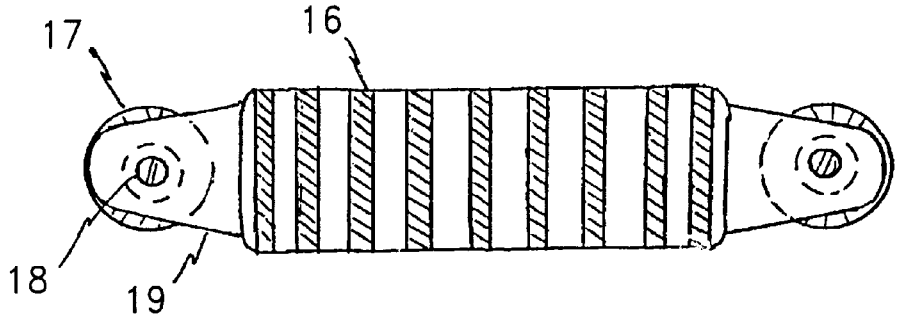
FIG. 11 shows the front view of an elongated, energy-absorbing enclosure with holed, flat ends for fastening onto the interior surface of a vehicle.

FIG. 11 shows a side view of an elongated energy-absorbing enclosure with holed, flat ends 19 for attachment to a desirable interior surface of the vehicle to protect a passenger's lower body from injury in the event of an accident. Holes 18 at the ends of enclosure 16 are for inserting a screw for either screwing into the material of the vehicle's interior surface or for screwing into the center of a suction cup 17, such as cup model No. TSC 158S by Suction Cups, Inc., 255 Banker St., Greenpoint, N.Y. 11222.

Figure 12:
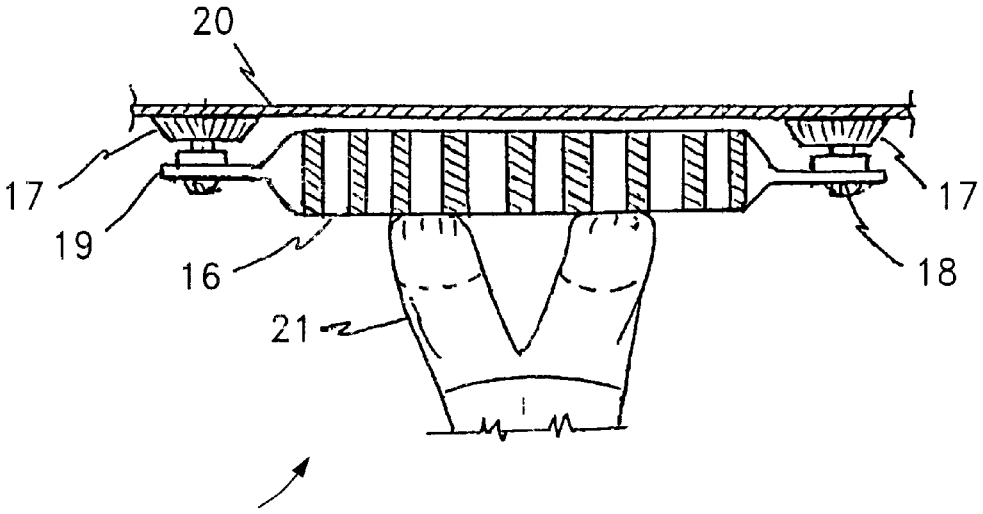
FIG. 12 shows end view of the enclosure of FIG. 11 attached to the surface material directly in front of a seated passenger with the aid of suction cups at the enclosures' ends and fast grip rubber cement.

FIG. 12 shows enclosure 16, installed, and fastened onto the surface material 20, near the location of a person's lower body. Although screws 18 could be screwed directly into surface material 20, in this top view screws 18 are screwed into suction cups 17. Then each cup 17 has safe-grip contact rubber cement added to its circular periphery surface. Cups 17, with cement, are placed against vehicle's surface 20 and held there until the fast-drying cement sets. The suggested cement is available from United Gibsonite Labs, Scranton, Pa. 18501. The cups may be removed from the vehicle's surface with a knife, whenever so desired. Enclosure 16 protects a passenger's knees from injury in the event of its collision with an object, such as another vehicle.

Figure 13:
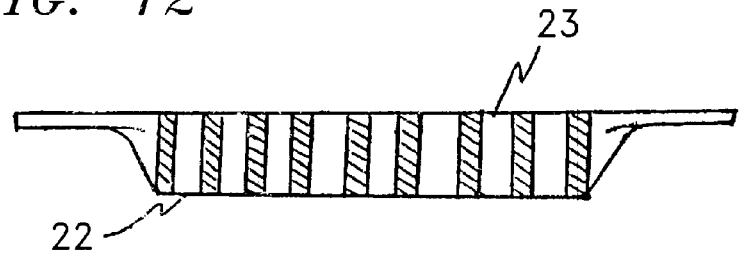
FIG. 13 shows the top view of a similar enclosure as FIG. 12, with a magnetically attractive rear surface for adhering to the metal interior surface of the vehicle at a person's knee height.

Another way to attach elongated energy-absorbing enclosure 16, FIG. 12, to a metal surface of auto's interior is shown in FIG. 13. This top view shows the enclosure shaped with an entirely flat rear surface 23, so that its ferrous magnetically attractable surface 23 will adhere to auto's ferrous metal surface. With this technique and design, no suction cups would be needed, nor screw holes need be made in the auto's interior metal surface. Its entire rear surface 23 of enclosure 22 need not be made ferrous metal, magnetically attractive, just portions to enable enclosure 22 to stay in position at knee-protective height. The stripes, shown shaded, indicates a green color. Other colors could be substituted. Such enclosures, of different sizes, also could be placed where air bags are presently located, eliminating the need for air bags, as shown in FIG. 14.

Figure 15:
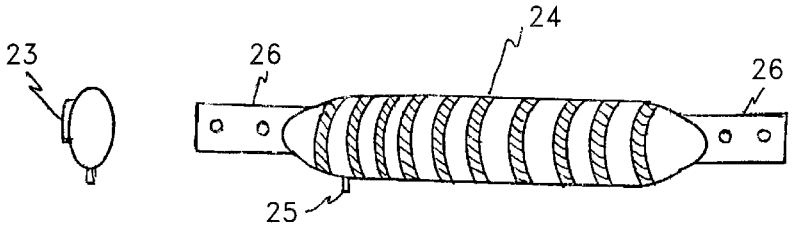
FIG. 15 shows a configuration of the energy-absorbing enclosure which is air inflatable.

Strips 26, FIG. 15, extending beyond the ends of enclosure 24, may have holes for fastening on to the vehicle's surface with screws or suction cups in the event that the material to which enclosure is fastened is not magnetically attractable ferrous metal.

Figure 14:
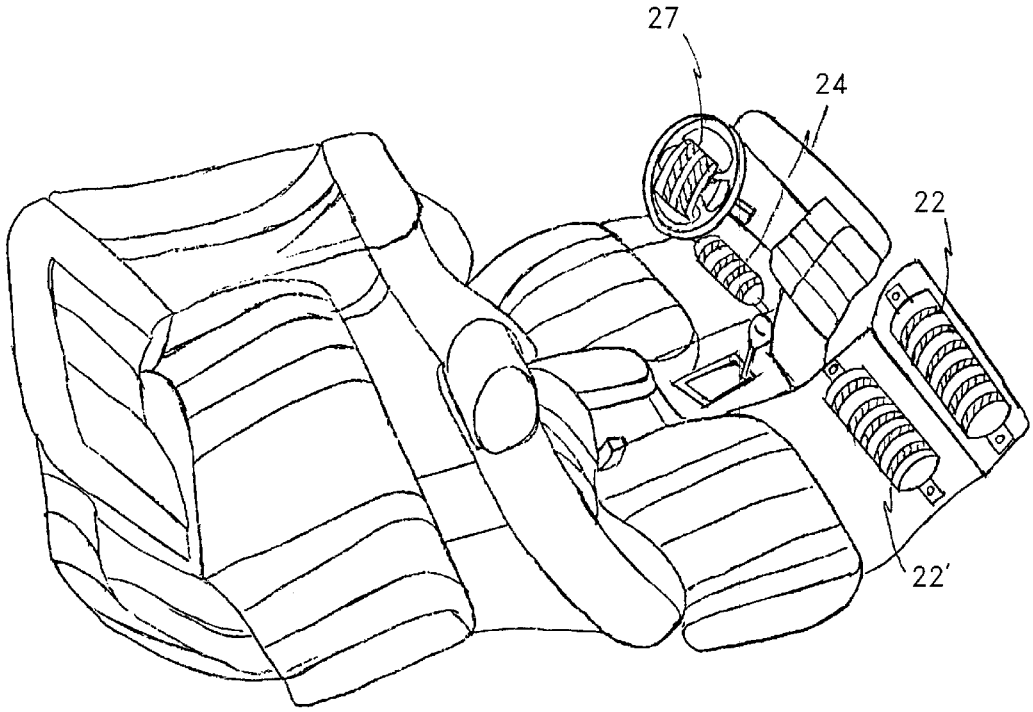
FIG. 14 shows the interior of a vehicle with energy-absorbing elongated enclosures magnetically adhered to the interior ferrous metal surfaces of the vehicle's interior portions where bodily-injury may be sustained in the event of the vehicle's sudden stoppage.

In FIG. 14, enclosures 22 and 22' are shown located and fastened not only at knee high locations, but also at locations where air bags are normally installed. These enclosures would come in different sizes to accommodate the available surfaces to which an enclosure is fastened. Protective enclosure 27 fastened to the steering wheel may be smaller in size and have provision for its being inflated to a larger size.

Figure 16:
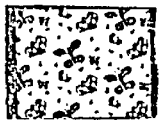
FIG. 16 shows colorful designs for beautifying the bodily-injury protective garments, such as red and yellow roses.
Figure 16:
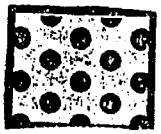
Figure 16:
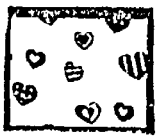
Figure 16:
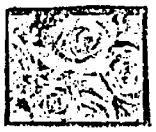
Figure 16:
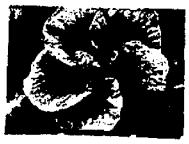
Figure 16:
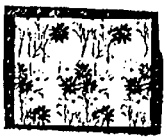
Figure 16:
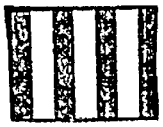
Figure 16:
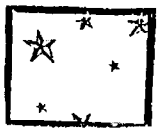
Figure 16:
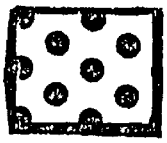
Figure 16:
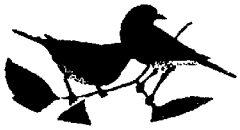

FIG. 16 shows colorful designs for beautifying the bodily-injury protective garments or for beautifying a vehicle's interior. Bodily-injury avoidance enclosure 27, on steering wheel, is designed to protect the face of the motorist in the event of an accident or sudden stopping of the vehicle.

Figure 17:
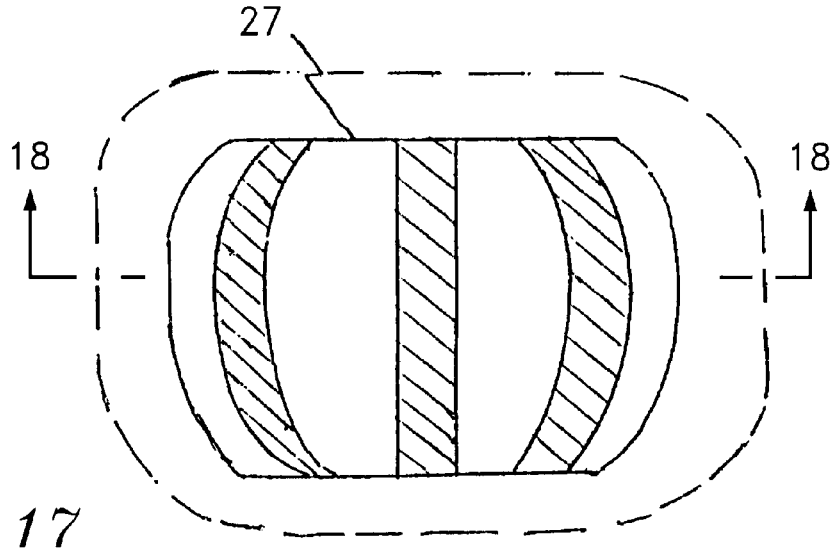
FIGS. 17 and 18 show top and elevation sectional views of a bodily-injury protection accessory in a vehicle with inflatable capability.
Figure 18:
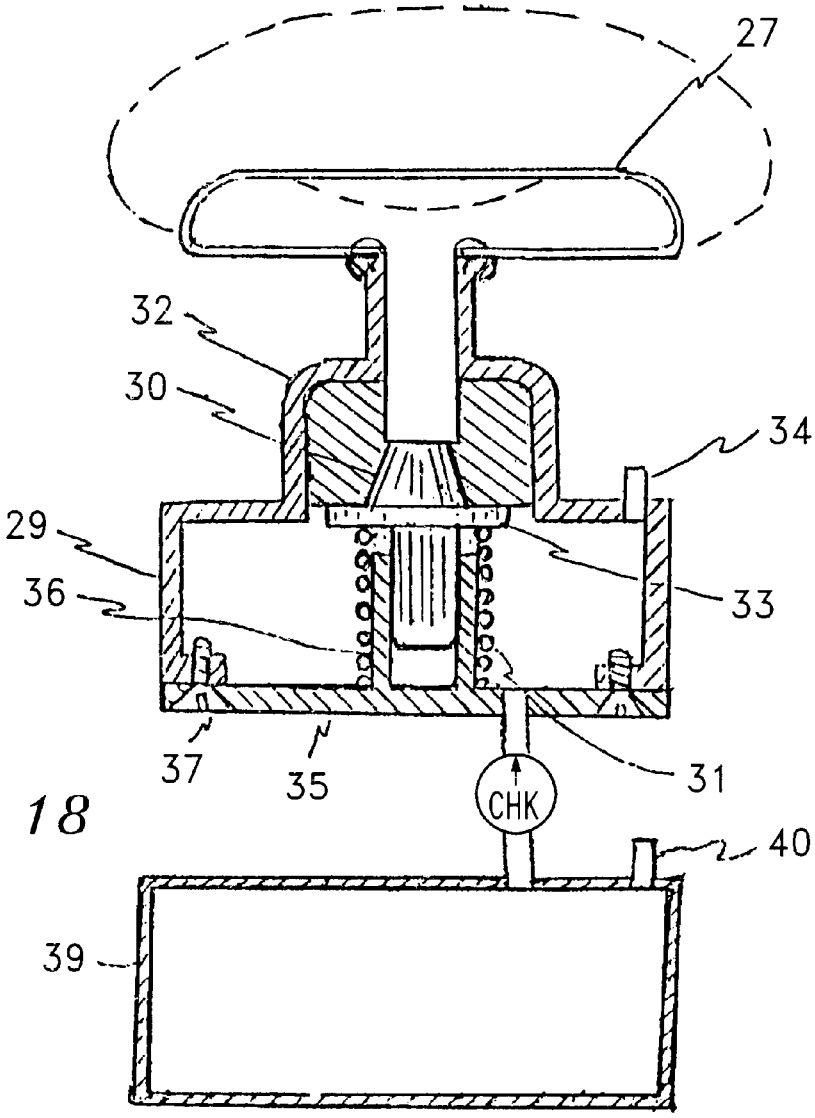

Material of enclosed 27 is elastic and capable of expanding. FIGS. 17 and 18 illustrate the technique for enabling enclosure 27 to expand further in case of an auto collision. The technique involves a spring-loaded air valve, normally kept air-tight closed by the tension of weak-spring 31.

Enclosure 27 may be filled with sponge rubber and air under pressure for initial protection of one's face and head. When one's head hits enclosure 27, air under pressure in the enclosure presses against top of coiled, spring-loaded cone-shaped plunger 30 and depresses weak-spring 31, allowing high pressure air tank 29 to further inflate elastic enclosure 27 and further protect the head of the motorist.

Tank 29 has sufficiently high pressure air for accomplishing the further inflation of enclosure 27. Enclosure 27 would have loose exterior material so this further inflation could be accomplished easily. Plunger 30 is tapered, cone-shaped, fitting into appropriately tapered hole within valve's body 32.

To ensure that plunger 30 closes air-tightly, the plunger has protruded ring or flange 33 with a flat inside surface, to provide not only an insertion stop to prevent plunger from getting stuck inside the cone-shaped cavity but also to be provided with a substance, such as rubber, or a gasket, to help provide air-tightness when plunger is in a closed position.

Cap 35, screwed air-tightly to container 29 by screws 37, includes cylindrical extension 36. Elevation FIG. 18 is a cross section of top view, FIG. 17, along line 18—18.

Figure 19:
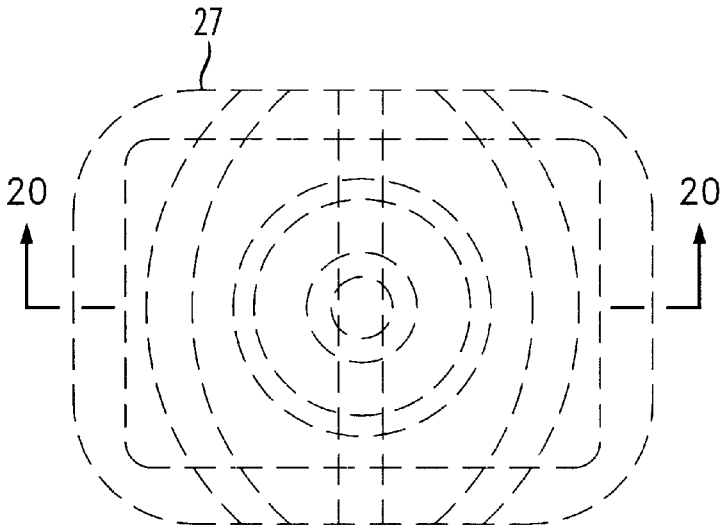
FIG. 19 shows a top view of the air bag in FIGS. 17 and 18, inflated.
Figure 20:
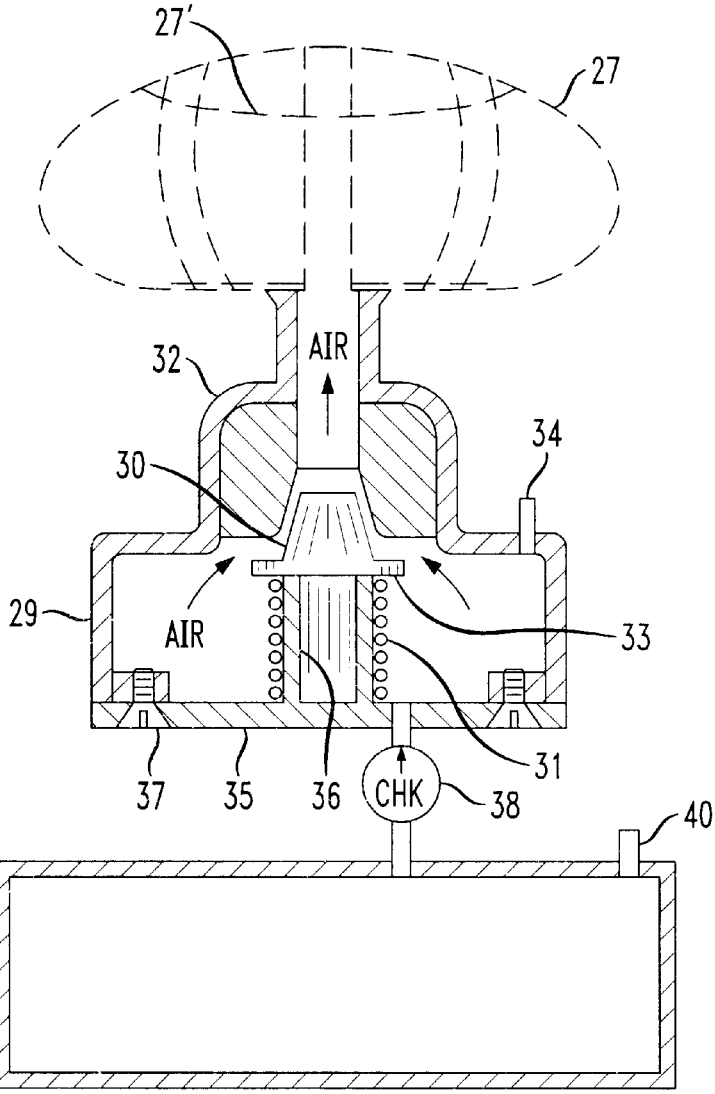
FIG. 20 shows an elevation cross sectional view of the air valve in its open position.

FIGS. 19 and 20 show the top and cross sectional elevation views of the inflatable air bag, with the enclosure 27 inflated. A person pushing down on enclosure 27 enables the enclosure to inflate. Plunger 30 is depressed by the existing air in enclosure 27, and plunger 30 depressing weak coiled spring 31, which has been keeping plunger in the shown closed position, as in FIG. 18. If there should be insufficient high pressure air in Chamber 29, then additional air could be supplied by a second Chamber 39 of high pressure air automatically via, check valve 38. Since the air in Chamber 29 is now lower than the pressure in Chamber 39, air automatically passes through check valve 38 to keep enclosure 27 inflated, protecting head of motorist from injury, should an auto collision occur.

FIG. 20 is a cross section of FIG. 19, along line 20-20. Air Valves 34, 40 enable Chambers 29 and 39 to be filled with sufficiently high pressure air from a pump. Initially, air in Chamber 39 has a slightly lower pressure air than the air in Chamber 29, so air does not flow through check valve 38, until some of Chamber 29's air has been consumed in inflating enclosure 27. Keeping enclosure 27 depressed, as indicated by dashed line 27', keeps air flowing into enclosure 27, until air in enclosure 29 equalizes with the pressure of air in enclosure 27. When equalization occurs, plunger 30 closes, by the small force of coiled spring 31, pushing the plunger up. The capacities and sizes of Chambers 29 and 39, FIG. 20, are not drawn-to-scale. Each may be larger or smaller than shown.

After enclosure 27 has been inflated and the crisis is over, the way to deflate enclosure is to open air valve 34 and to push down on top of the inflated enclosure, until the desired amount of air has been released. Then, the air in Chambers 29 and 39 may be replenished with an air pump until the desired air pressures are achieved.

If someone should accidentally puncture enclosure 27, either the hole would be patched air-tightly or the enclosure could be replaced, if designed to be replaceable, by removing screws underneath enclosure 27 and a resilient rubbery gasket. Bead sealer for auto tires may be applied to the gasket to assure air tightness, available from Nata Auto Supply Stores.

I claim:

1. Decorative bodily injury protective protection enclosures for a person when playing outdoors or sitting in a vehicle, providing protection for the person's body portions, including neck, hips and knees, the injury-vulnerable portions of a person's body, wherein lightweight air-inflatable donut-shaped enclosures being applied to said neck, said hips and said knees, said inflatable donut-shaped enclosures containing energy-absorbing material and having stretchable elastic tie portions to assist in putting on and retaining said donut-shaped enclosures on said body; and a pleasing decoration being applied to the surface of said enclosures; the neck and knee donut-shaped enclosures being smaller in circumference than the enclosures applied to said hips; said enclosures being moisture resistance, preventing moisture from passing through the material of said enclosures, and wherein said vehicle having elongated, inflated enclosures in vulnerable, bodily-injury locations within said vehicle, including on surfaces in front of passengers' knees and on top of a steering wheel.

2. Decorative bodily injury protective protection enclosures in accordance with claim 1, wherein said donut-shaped enclosures being made of stretchable, elastic material to better enable said enclosures to be pulled onto a body portion, and be retained thereon.

3. Decorative bodily-injury protective enclosures in accordance with claim 1 wherein said enclosures being for an elderly person's body, including said person's ankles, wherein said body portions covered and protected being the neck with a cervical collar, being the waist with a donut-shaped enclosure, being the knees with donut-shaped enclosures, being the ankles having spats with energy-absorbing filler material.

4. Decorative bodily-injury protective enclosures in accordance with claims 1, wherein said gear being fitted with strips of hook and loop fastener ends for fastening together said gear around each of said portions.

5. Decorative body protection gear for an active person, in accordance with claim 1, wherein said person having knees and being seated in a vehicle having an inside surface, and said knees being pressed against an elongated energy-absorbing enclosure, said enclosure having flat ends, each of said ends having at least one hole, and provision provided for fastening each of said ends to the vehicle's inside surface directly in front of a seated person's lower body, said enclosure providing bodily-injury protection for said person.

6. Decorative body protection gear for an active person, in accordance with claim 5, wherein said hole allowing a screw to pass through and screw into the center portion of an adequately sized suction cup, said suction cup adhering to said surface and enabling said enclosure to be held in place to protect the knees of said person from injury.

* * * * *